US011565137B2

(12) United States Patent
Morin et al.

(10) Patent No.: US 11,565,137 B2
(45) Date of Patent: Jan. 31, 2023

(54) RAPID DONNING FACE MASK

(71) Applicants: John H. Morin, Nashville, TN (US); Dorothy Arvanitis, Boston, MA (US)

(72) Inventors: John H. Morin, Nashville, TN (US); Dorothy Arvanitis, Boston, MA (US)

( * ) Notice: Subject to any disclaimer, the term of this patent is extended or adjusted under 35 U.S.C. 154(b) by 281 days.

(21) Appl. No.: 16/949,606

(22) Filed: Nov. 6, 2020

(65) Prior Publication Data

US 2022/0143436 A1 May 12, 2022

(51) Int. Cl.

| | |
|---|---|
| ***A62B 23/02*** | (2006.01) |
| ***A62B 18/02*** | (2006.01) |
| ***A41D 13/11*** | (2006.01) |
| ***A62B 18/08*** | (2006.01) |
| *A41D 13/08* | (2006.01) |

(52) U.S. Cl.

CPC ..... *A62B 23/025* (2013.01); *A62B 18/025* (2013.01)

(58) Field of Classification Search

CPC .... A62B 23/00–025; A62B 18/00–025; A62B 18/08; A62B 18/084; A62B 7/00; A62B 7/10; A41D 13/11–1192

See application file for complete search history.

(56) References Cited

U.S. PATENT DOCUMENTS

| | | | | |
|---|---|---|---|---|
| 3,896,498 | A | 7/1975 | Pang | |
| 4,195,629 | A * | 4/1980 | Halford | A41D 13/1161 128/206.13 |
| 4,617,684 | A | 10/1986 | Green et al. | |
| 5,196,244 | A * | 3/1993 | Beck | A61F 13/00034 128/207.14 |
| 5,322,060 | A * | 6/1994 | Johnson | B01D 39/1676 128/205.12 |
| 5,864,883 | A * | 2/1999 | Reo | A41D 19/01 2/161.6 |
| 6,123,077 | A * | 9/2000 | Bostock | A41D 13/11 128/206.19 |
| 6,948,499 | B2 | 9/2005 | Griesbach, III et al. | |
| 3,006,694 | A1 | 8/2011 | Marx | |
| 7,997,275 | B2 | 8/2011 | Quinn | |
| 2003/0172932 | A1 | 9/2003 | Matioc | |
| 2004/0151762 | A1* | 8/2004 | Pridgen | A61F 13/15 424/443 |
| 2004/0194191 | A1 | 10/2004 | Ostrov et al. | |
| 2005/0194010 | A1 | 9/2005 | Sankot | |
| 2006/0254591 | A1 | 11/2006 | Marx | |
| 2011/0226253 | A1* | 9/2011 | Johnston | A41D 13/1123 128/206.19 |
| 2014/0007888 | A1 | 1/2014 | Sanchez Talero | |
| 2014/0182592 | A1 | 7/2014 | Aharoni | |
| 2014/0325738 | A1 | 11/2014 | Marovets | |
| 2018/0084847 | A1 | 3/2018 | Doctor | |
| 2019/0053550 | A1 | 2/2019 | Abdo | |

* cited by examiner

*Primary Examiner* — Michelle J Lee

(74) *Attorney, Agent, or Firm* — Squire Patent Consulting & IP Law LLC; Brendan E. Squire

(57) ABSTRACT

A rapid donning face mask is disclosed. The rapid donning face mask is desirable for emerging situations in which the user is unable to maintain proper social distancing. When needed the user deploys a filter element that is coupled to the fingers of a user's hand via rings. As the user splays their fingers, the filter element deploys, allowing the user to cover their mouth and nasal openings with the filter element.

2 Claims, 3 Drawing Sheets

RAPID DONNING FACE MASK

BACKGROUND OF THE INVENTION

The present invention relates to protective masks, and more particularly to replaceable face masks for preventing the spread of pathogens.

Currently face masks are cumbersome to use. Adoption of use of face masks is low because it takes time and effort to install a face mask, and they can be uncomfortable. Protective face masks can hurt the wearer, can make breathing difficult, and take time to cover and uncover your face.

With current restrictions, face masks are encouraged when social distancing cannot be maintained. During activities, such as walking, running, and personal grooming such as haircuts, individuals can usually maintain proper social distancing. However, when temporarily encountering another individual, such as passing in the same direction or in opposite directions, proper social distancing is difficult to maintain, particularly on narrow pathways or trails. In these circumstances it can be difficult to quickly don a mask when approaching another person.

As can be seen, there is a need for an improved respiratory air filtration mask that can be rapidly donned when social distancing cannot be maintained.

SUMMARY OF THE INVENTION

In one aspect of the present invention, a rapid donning face mask is disclosed. The rapid donning facemask includes a filter element having a peripheral edge surface defining a boundary of the filter element. A plurality of rings is attached to the peripheral edge surface. The plurality of rings are dimensioned to fit a plurality of fingers of a hand of a user.

In some embodiments, the filter element is moveable between a stowed condition in which the filter element is collapsed with a closure of the plurality of fingers and a ready condition in which the filter element is expanded with a splaying of the plurality of fingers.

In some embodiments, a tab is provided to operatively couple the plurality of rings to the filter element.

In some embodiments, the plurality of rings is attached at opposed ends of the filter element. One of the plurality of rings is configured to be worn on a first digit of the user and a second of the plurality of rings is configured to be worn on another digit of the user's hand.

In yet other embodiments, a pocket is carried by the filter element. The pocket has an opening into an interior cavity dimensioned to carry an object in a palm of the hand.

In other aspects of the invention, a method of rapidly donning a protective mask is disclosed. The method includes providing a filter element having a peripheral edge surface defining a boundary of the filter element. A plurality of rings is attached to the peripheral edge surface. The method includes placing each of the plurality of rings on a separate finger of a user's hand.

When placed, closing the fingers of the user's hand places the filter element in a stowed or a collapsed condition. Likewise, splaying the fingers of the user's hand places the filter element in a ready condition. In the ready condition, the method includes placing the filter element over a mouth and a nasal opening of the user. The method may also include positioning the filter element on a back side of the user's hand by rotation of the plurality of rings about the user's fingers.

These and other features, aspects and advantages of the present invention will become better understood with reference to the following drawings, description and claims.

DETAILED DESCRIPTION

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide a rapid donning face mask that allows the user to rapidly emplace a protective mask in emerging situations where the ability to maintain proper social distancing is unavoidable. The rapid donning face mask includes a filter element that is suspended in the user's hand when in a carried position. When needed, the user may expand their fingers to deploy the filter element so that they may temporarily cover their mouth and nasal openings.

As seen in reference to the drawings of FIGS. 1-7, non-limiting embodiments of a rapid donning face mask 10, 20, 30, and 40 are illustrated. In a first embodiment of the rapid donning face mask 10, a filter element 12 has a plurality of rings 14 attached to a peripheral edge surface of the filter element 12. A tab 14*a* may be utilized to attach the filter element 12 to each of the plurality of rings 14. The plurality of rings 14 are dimensioned to fit about the fingers of the wearer's hand, such that the filter element is carried in a palm 11*b* of the user's hand 11. In a stowed condition, the mask 10 can be carried in a collapsed condition, shown in FIG. 2, such as a balled first or a curled hand when the user may be walking or running.

Figure 1:
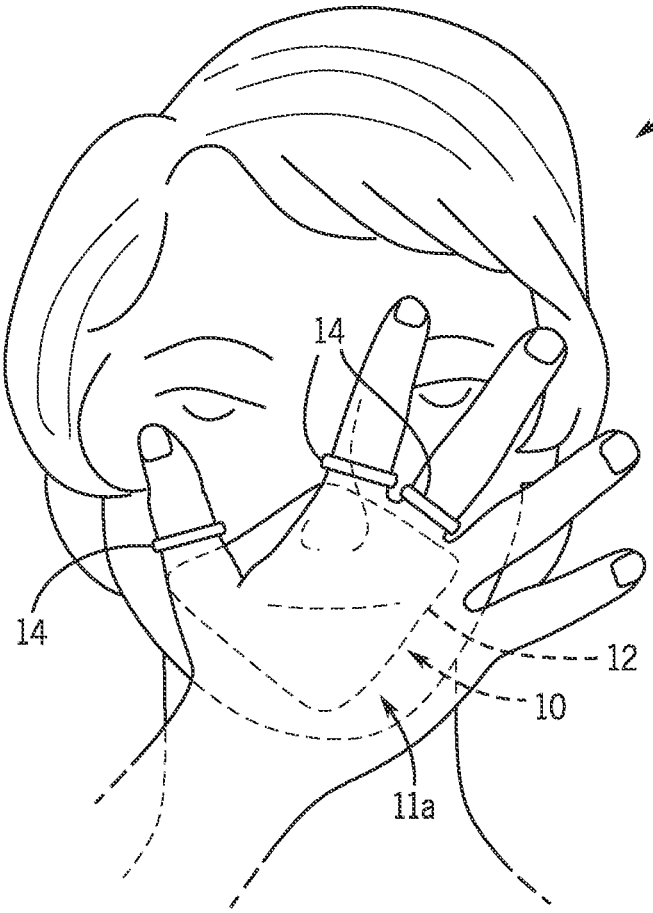
FIG. 1 is a front elevation view rapid donning face mask in use, showing the back of the user's hand, with the hand in an open, expanded configuration.
Figure 2:
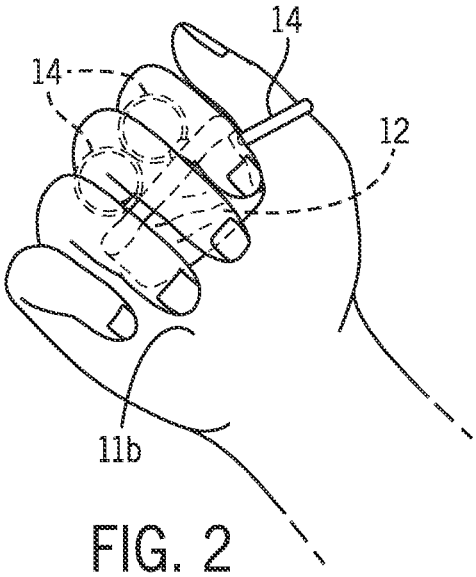
FIG. 2 is a front elevation view of the invention, showing the user's hand in a closed, contracted configuration.
Figure 3:
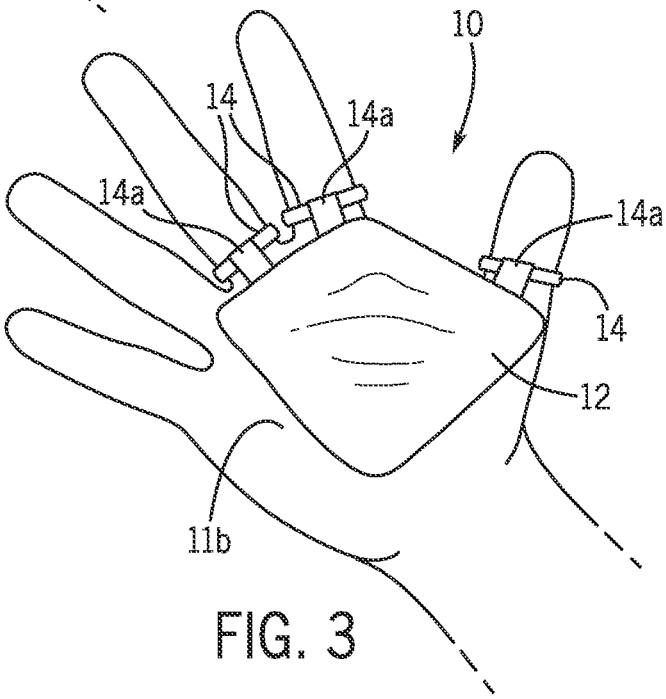
FIG. 3 is a front elevation view rapid donning face mask showing the front of the user's hand in an open, expanded configuration.
Figure 4:
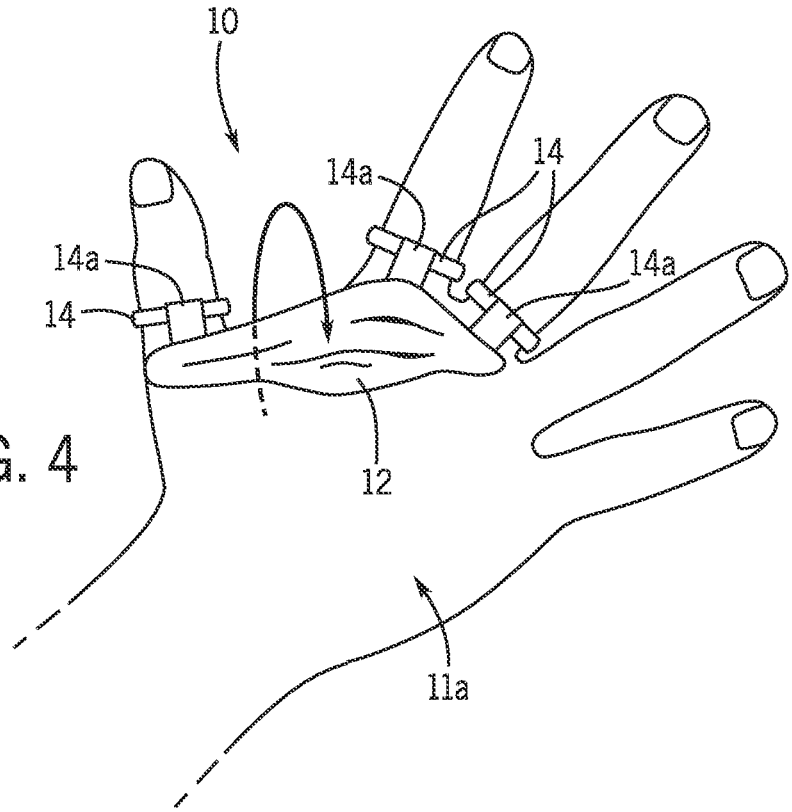
FIG. 4 is a rear elevation view rapid donning face mask showing the back of the user's hand in an open, expanded configuration.

As the user approaches another individual and may have difficulty maintaining proper social distancing, the user simply splays their fingers causing the filter element 12 to be expanded to a ready position, such as shown in FIG. 3. The user may then quickly cover their mouth and nasal passages, as shown in FIG. 1, while passing or in close proximity to the other individual. As they regain a proper social distance, the user can simply return the mask 10 to the collapsed or a stowed condition and resume their activity. The mask 10 may be suitable for athletic activities or other activities where a mask would be temporarily needed when it is difficult to maintain social distancing.

In some instances, the user may need use of their hands. In this case, the filter element 12 can be positioned on the back side of the user's hand by rotation of the rings 14 about the fingers. With the mask 10 stowed in this position, the user can grasp objects without contaminating the mask 10.

Figure 5:
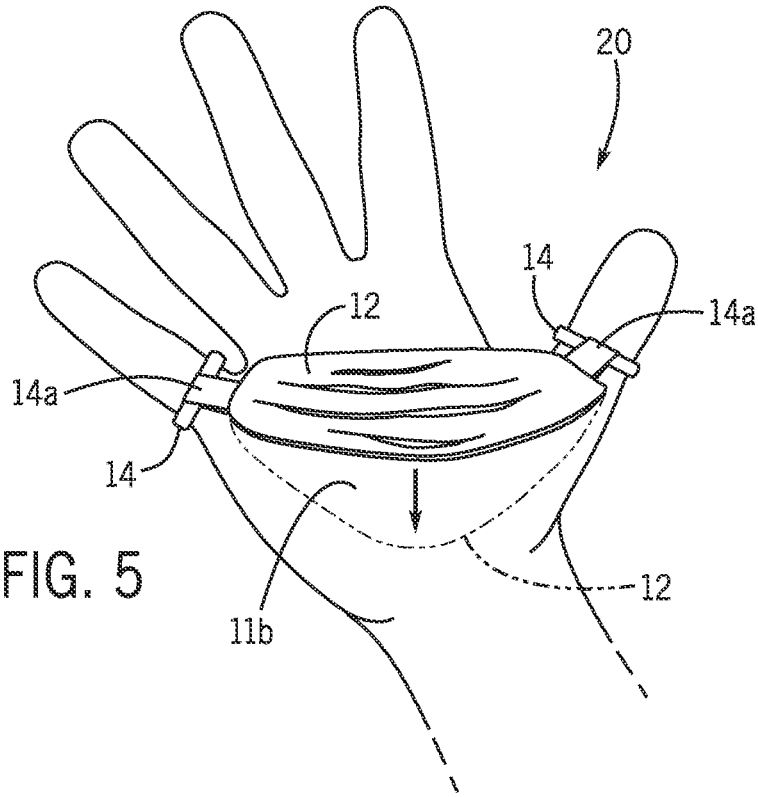
FIG. 5 is a front elevation view showing the second embodiment of the invention.

In another embodiment, shown in FIG. 5, an alternative embodiment of the mask 20 is shown. The alternative embodiment of the mask 20 includes a ring 14 be attached to opposite ends of the filter element 12. In this embodiment, a first ring 14 may be secured to a first digit of the user's hand, while a second ring 14 is attached to a second digit, such that with the first digit and the second digit are splayed, the mask 20 is expanded to the deployed condition. In the non-limiting embodiment shown, the first digit is a thumb and the second digit is a pinkie providing maximum expansion of the filter element 12 in the deployed condition. The rings 14 may be secured to the filter element 12 via a tab 14*a* or a loop structure. Deployment and donning of the mask 20 are similar to that described for the first embodiment of the mask 10.

Figure 6:
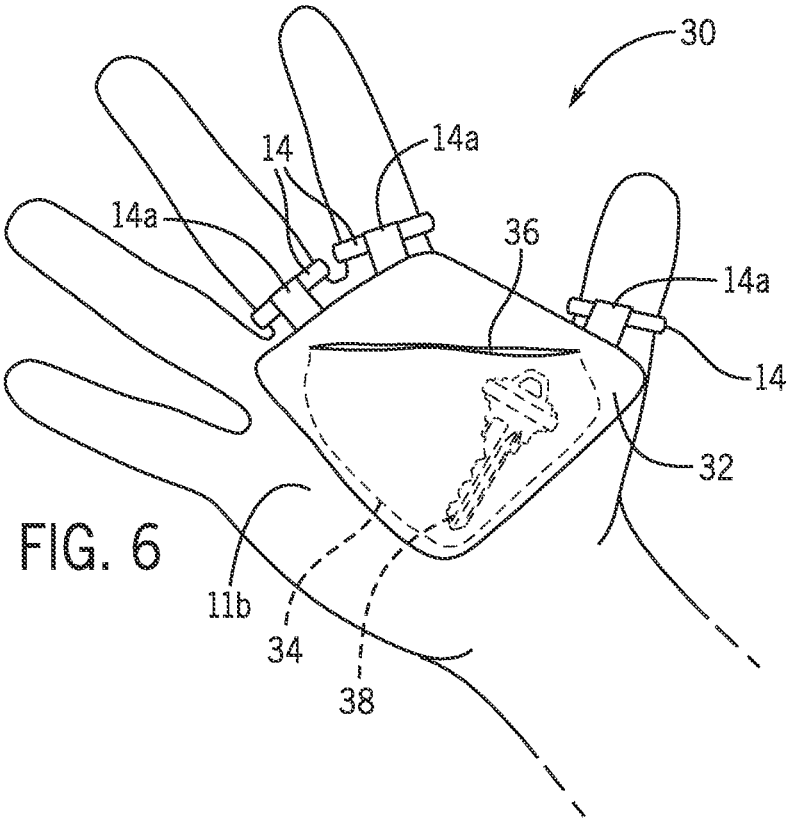
FIG. 6 is a front elevation view showing the third embodiment of the invention.

In another embodiment, such as shown in FIG. 6, the mask 30 includes a pocket 34 or a sleeve carried by the filter element 32. The pocket has an opening 36 through which a small object such as a key 38 may be carried.

Figure 7:
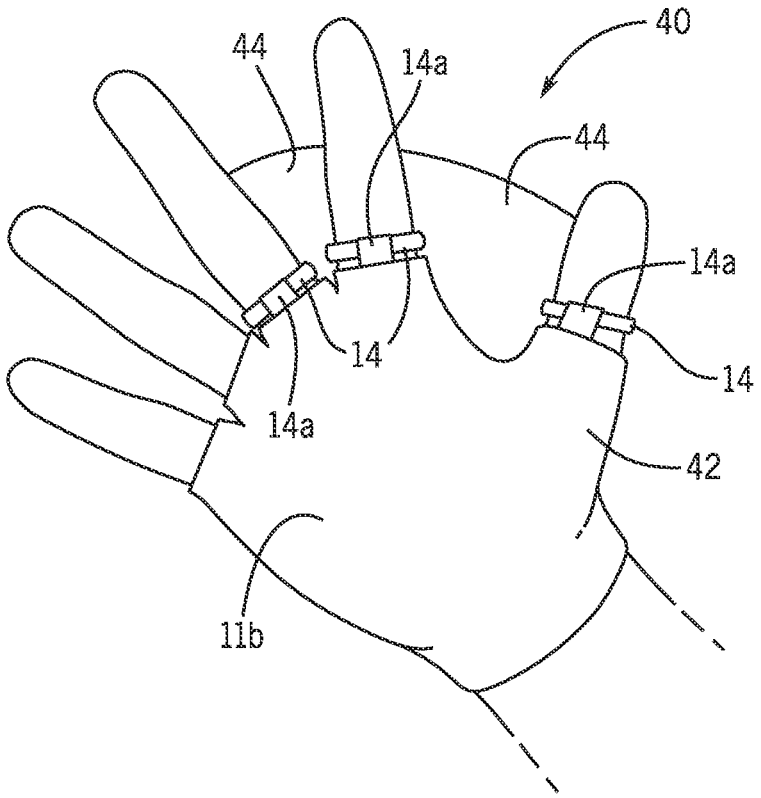
FIG. 7 is a front elevation view showing the fourth embodiment of the invention.

In yet another embodiment, shown in FIG. 7, the mask 40 is formed having a filter element 42 shaped as a partial glove dimensioned to cover the wearer's palmar region. In this embodiment, the filter element also includes one or more webs 44 suspended by the rings 14 between the wearer's fingers. When the user splays their fingers, the web elements 44 expand to provide a greater coverage to the wearer's face. This particular embodiment also provides the individual passed a visual indication that the user is temporarily covering their face with a filter element 12 rather than ignoring social distancing and mask restrictions. The rings 14 may also provide a visual indication of the user having a mask covering within their hand.

As will be appreciated the filter elements may be made of any suitable woven or non-woven material selected based on characteristics of a prevalent pathogen or airborne contaminant. The filter element may include one or more layers of a filter media. Likewise, the rapid donning mask may be formed in a disposable variety or a washable material for reuse.

It should be understood, of course, that the foregoing relates to exemplary embodiments rapid donning face mask and that modifications may be made without departing from the spirit and scope of the invention as set forth in the following claims.

What is claimed is:

1. A method of rapidly donning a protective mask, comprising:

providing a filter element having a peripheral edge surface defining a boundary of the filter element; a plurality of rings attached to the peripheral edge surface; and placing each of the plurality of rings on a separate finger of a user's hand such that the filter element is on the palm side of the user's hand;

splaying the fingers of the user's hand to place the filter element in a ready condition;

placing the filter element over a mouth and a nasal opening of the user; and positioning the filter element on a back side of the user's hand opposite the palm side by rotation of the plurality of rings about the user's fingers.

2. The method of claim 1, further comprising:

at least partially closing the fingers of the user's hand to place the filter element in a stowed condition.

* * * * *